United States Patent [19]

Felton, Jr.

[11] 3,983,044

[45] Sept. 28, 1976

[54] LOW SMOKING LUBRICATING COMPOSITION FOR COLD HEADING OPERATIONS

[75] Inventor: George F. Felton, Jr., Chadds Ford, Pa.

[73] Assignee: Sun Oil Company of Pennsylvania, Philadelphia, Pa.

[22] Filed: June 16, 1975

[21] Appl. No.: 587,511

Related U.S. Application Data

[63] Continuation-in-part of Ser. No. 457,040, April 1, 1974, abandoned.

[52] U.S. Cl. ..... 252/33.6; 72/42; 252/49.3; 252/52 A

[51] Int. Cl.[2] ..... C10M 1/54; C10M 1/38

[58] Field of Search ..... 252/33.6, 42.1, 49.3, 252/52 A

[56] References Cited

UNITED STATES PATENTS

| | | | |
|---|---|---|---|
| 2,237,096 | 4/1941 | Dearborn | 252/33.6 X |
| 2,981,686 | 4/1961 | Reamer | 252/33.6 |
| 3,227,652 | 1/1966 | Ackerman | 252/49.3 X |
| 3,278,430 | 10/1966 | Williams | 252/42.1 X |
| 3,526,596 | 9/1970 | Kress et al. | 252/52 A X |

FOREIGN PATENTS OR APPLICATIONS

| | | | |
|---|---|---|---|
| 306,164 | 3/1969 | U.S.S.R. | 252/33.6 |

OTHER PUBLICATIONS

Bastian, "Metalworking Lubricants" 1951, p. 19.

*Primary Examiner*—Delbert E. Gantz
*Assistant Examiner*—Andrew H. Metz
*Attorney, Agent, or Firm*—J. Edward Hess; Donald R. Johnson; Anthony Potts, Jr.

[57] ABSTRACT

A low smoking lubricating composition for cold forming metal contains certain amounts of water, potassium nitrite, potassium soap of a chlorinated fatty acid, potassium soap of a sulfurized fatty acid, glycerine, defoaming agent and a block copolymer of ethylene oxide grafted on a polypropylene oxide which copolymer has a suitable molecular weight range and contains a sufficient amount of ethylene oxide to cause the composition to remain homogeneous between ambient temperature and the composition's boiling temperature.

7 Claims, No Drawings

LOW SMOKING LUBRICATING COMPOSITION FOR COLD HEADING OPERATIONS

CROSS REFERENCE TO RELATED APPLICATIONS

This application is a continuation-in-part of U.S. patent application Ser. No. 457,040 filed Apr. 1, 1974 and now abandoned.

BACKGROUND OF THE INVENTION

In the past cold working metal parts generally have been lubricated with oil-based lubricants. This lubrication with oil gives good die life and satisfactory finished product but results in considerable smoking during the operation.

SUMMARY OF THE INVENTION

The present invention relates to a water-based lubricant for use in cold-forming metal parts such as nuts, bolts, etc. The lubricant provides an aqueous solution of a polyalkylene glycol which precipitates out of solution to provide a solid lubricant at elevated temperatures. The lubricant also employs extreme pressure additives, an anticorrosion agent and a defoamer. The resulting composition has a much lower smoke level in use than previously used materials and results in cold-formed parts which have a bright metallic appearance rather than the scorched appearance which is typical when an oil-based lubricant is used. The blend of the present invention also exhibits excellent freezing stability, i.e., after freezing it again forms a homogeneous mixture. Further the blend remains homogeneous on heating it to boiling temperatures.

DESCRIPTION OF THE INVENTION

The present invention relates to a water-based lubricant for cold-forming metals. Cold-forming metals are commonly used to form many articles. The mechanical working of the metal involved strengthens the metal so that many common metallic parts such as nuts, bolt heads, rivet heads, etc. are formed in this way. The present composition is also useful as a lubricant in turning metals, thread cutting, tapping and thread rolling. The technique is most commonly applied to mild steels, but is also used on high carbon steels, stainless steel, etc. The steel starting piece is generally a rod or wire which is cut or sheared to give a blank of the desired size. This blank is then stamped with one or more dies to form it into the desired shape. Although the metal blank starts off at ambient temperature it reaches elevated temperatures of several hundred degrees centigrade during the process due to the frictional energy used in the forming process.

The present invention provides an aqueous solution of lubricant which can be sprayed or flooded onto the workpiece. As the workpiece becomes hot due to mechanical working, the lubricant is precipitated from the water and provides excellent lubrication. The material used which provides this function is a block copolymer which has a central portion of polypropylene oxide with ethylene oxide grafted on the ends. Polypropylene oxide alone is unsatisfactory for this purpose because while liquid it is inadequately soluble in water. Polyethylene oxide of the desired molecular weight is a solid at ordinary temperatures and for this reason is unsatisfactory. The block copolymer provides a liquid at ordinary temperatures with sufficient hydrophilic ethylene oxide groups to provide solubility in water.

In addition, the block copolymer also enables the composition to be homogeneous between ambient temperature and its boiling temperature. Lack of homogeneity can be indicated by, for example, haziness and/or formation of a gel and/or separation of the composition into two or more layers. The lack of homogeneity has an adverse effect on the metal during the forming step. Rusting and a lack of a bright metallic appearance are two possible examples of such adverse effects. Influencing this homogeneity is the molecular weight of the copolymer and the amount of ethylene oxide contained therein. Thus as discussed in the Example a copolymer having 40% ethylene oxide and a molecular weight of 2200 is a satisfactory copolymer whereas a copolymer containing the same 40% ethylene oxide but having a different molecular weight of 2900 is unsatisfactory. Thus in this invention the molecular weight of the copolymer has a suitable range and contains a sufficient amount of ethylene oxide to cause the composition to remain homogeneous between ambient temperature and the boiling temperature of the composition. A preferred range of molecular weight for the copolymer is between about 1000 and about 2800. A preferred amount of ethylene oxide is in a range of about 10 to about 50%, with a more preferred amount is in a range of about 35 to about 45%.

The composition generally will contain from 45 to 200 parts by weight of water and from 30 to 35 parts by weight of the above-described copolymer.

To improve the lubricity and load carrying ability of the composition extreme pressure additives are included therein. In the present invention two such additives are employed. The first is from 1 to 15 parts by weight of a sulfurized material. The material is a naturally occurring triglyceride such as lard oil. Any such naturally occurring triglyceride is satisfactory. Generally the fatty acid portion of such triglyceride will be derived from fatty acids containing from 9 to 22 carbon atoms and at least 45% of the fatty acid moieties will contain at least one carbon-carbon unsaturated double bond. Generally this unsaturated acid is oleic acid. This material is sulfurized by cooking with sulfur. Generally from 5 to 25 weight % elemental sulfur is added to 95 to 75 weight % of the triglyceride and the mixture cooked at 335°–440°F. 168°–227°C. for ½ to 2 hours. The use of 365°F. 185°C. and 1 hour is preferred. The resulting material is added to the aqueous lubricant solution and saponified with potassium hydroxide. Potassium hydroxide is used because other soaps such as sodium form a cloudy solution when used in the present invention. A slight molar excess of potassium hydroxide should be used to achieve complete saponification of the triglyceride. This excess also helps inhibit corrosion.

The second extreme pressure additive is present in an amount of from 1 to 10 parts by weight and is a chlorinated triglyceride. The triglyceride starting material used here is the same as that above. The material is chlorinated so as to contain from 25 to 50 weight % chlorine. When preparing the lubricant this additive is added to the water and saponified with potassium hydroxide. Again a slight excess of potassium hydroxide should be used. The polyglycol is added to blend before sulfur and chlorine additives are added to be saponified. The presence of the polymer greatly aids in making a smooth blend. If not added first an unhomogeneous mixture is obtained.

The composition also contains potassium nitrite as a corrosion inhibitor. Generally from 0.5 to 10 parts of the nitrite is incorporated in the composition.

Generally a very small amount of a defoaming agent is incorporated in the composition. Usually from 0.03 to 0.5 parts by weight of defoamer is adequate. The dimethylsilicone polymers are particularly suitable defoamers.

The composition also preferably contains from 1 to 10 parts by weight of glycerine. The glycerine provides a solubilizing medium for the potassium hydroxide and potassium nitrite when the water evaporates.

The following example illustrates the invention, also shown are comparative results.

EXAMPLE 1

A composition was prepared containing 51.15 parts by weight of water, 1.75 parts by weight of potassium hydroxide, 2.00 parts by weight of potassium nitrite, 32.00 parts by weight of a block copolymer of polyethylene oxide and polypropylene oxide containing 40 weight % ethylene oxide and 60 weight % propylene oxide wherein the ethylene oxide is grafted on the ends of a propylene oxide polymer and having a molecular weight of 2200, 5.00 weight % of sulfurized fatty acid containing 14 weight % sulfur which product has a saponification number of 53, 5.00 parts by weight of a chlorinated fatty acid containing 35 weight percent chlorine which product has an average molecular weight of 345, an acid number of 90 and a viscosity at 100°F. (38°C.) of 22,000 SUS, 0.10 parts by weight of a dimethylsilicone defoamer and 3.00 parts by weight of glycerine. This composition gave a viscosity of 800–900 Saybolt Universal Seconds at 100°F. (38°C.). Also, this composition remained clear and did not separate at either ambient temperaure or upon heating to its boiling temperature. Also the composition did not appear to gel.

Sodium nitrite was unsatisfactory because of the nonhomogeneity.

This composition was used in a cold-forming operation forming ¾ inch hexagonal nut blanks from a ¾ inch rod of AISI 1038 steel at a rate of two blanks per second. The steel rod initially was at ambient temperature and the final nut blanks were at 400°F. (204°C.) due to the heat developed in the forming operation. The forming was done in five steps and each die used in these steps was alternately flooded with the above composition. In this test nut blanks were fabricated at a rate of two per second for about 5 hours with satisfactory lubrication and no abnormal maintenance which indicates satisfactory lubrication was achieved. The nut blanks had a bright metallic appearance indicating no overheating during the die-forming steps. This test is regarded as a very severe test of a metal-working lubricant. Also there was a drastic reduction in smoke compared to an oil composition.

Five other compositions were also prepared. The compositions contained the components disclosed for the composition described heretofore except that the molecular weight of the block copolymer and the amount of ethylene oxide contained in the block copolymer were different. These different values are shown in the accompanying table.

TABLE

| | | | | | |
|---|---|---|---|---|---|
| Molecular Weight of Block Copolymer | 1100 | 1630 | 1850 | 2650 | 2900 |
| % Ethylene Oxide in Block Copolymer | 10 | 20 | 30 | 30 | 40 |

The foregoing five compositions were unsatisfactory because they became hazy and/or separated into two layers and/or appeared to gel either at room or their boiling temperatures. Haziness indicated that a component was not remaining in solution. Gelling would cause pumping problems because of high viscosity. Thus non-homogeneous compositions are undesirable because of their adverse effect on the metal during the cold-forming step.

The invention claimed is:

1. A normally liquid composition useful as a cold forming, metal working lubricant comprising:

a. 45 to 200 parts by weight of water;

b. 30 to 35 parts by weight of a block copolymer of ethylene oxide grafted on a polypropylene oxide which copolymer has both a molecular weight range and ethylene oxide content sufficient to cause the composition to remain homogeneous between ambient temperature and the boiling temperature of the composition;

c. 1 to 15 parts by weight of a potassium soap of a sulfurized naturally occurring triglyceride containing from 5 to 25 weight percent sulfur;

d. 1 to 10 parts by weight of a potassium soap of a chlorinated naturally occurring triglyceride containing from 25 to 50 weight percent chlorine; and e. 0.5 to 10 parts by weight of potassium nitrite.

2. The composition of claim 1 which further contains from 1 to 10 parts by weight of glyceride.

3. The composition of claim 1 wherein the molecular weight of the copolymer is in the range of about 1000 to about 2800.

4. The composition of claim 1 wherein the amount of ethylene oxide is in a range of about 10 to about 50%.

5. The composition of claim 3 wherein the amount of ethylene oxide is in a range of about 35 to about 45%.

6. The composition of claim 5 which further contains from 1 to 10 parts by weight of glycerine.

7. The composition of claim 6 which further contains from 0.03 to 0.5 parts by weight of a dimethylsilicone defoaming agent.

* * * * *